US007996946B1

(12) United States Patent
Riley

(10) Patent No.: US 7,996,946 B1
(45) Date of Patent: Aug. 16, 2011

(54) CLEANING PROJECTILE VERIFICATION SYSTEM

(76) Inventor: Bruce Riley, Millville, NJ (US)

( * ) Notice: Subject to any disclaimer, the term of this patent is extended or adjusted under 35 U.S.C. 154(b) by 447 days.

(21) Appl. No.: 12/220,030

(22) Filed: Jul. 21, 2008

Related U.S. Application Data

(63) Continuation-in-part of application No. 11/265,356, filed on Nov. 2, 2005, now abandoned.

(51) Int. Cl.
*B08B 9/055* (2006.01)
*B08B 9/057* (2006.01)
*F28G 1/12* (2006.01)

(52) U.S. Cl. ..... 15/3.51; 165/95

(58) Field of Classification Search ..... 15/3.5, 15/3.51; 165/95
See application file for complete search history.

(56) References Cited

U.S. PATENT DOCUMENTS

| | | | | | |
|---|---|---|---|---|---|
| 1,547,440 | A | | 7/1925 | Penn | |
| 1,806,270 | A | | 5/1931 | Thompson | |
| 3,453,882 | A | | 7/1969 | Kirkendall et al. | |
| 3,552,053 | A | | 1/1971 | Jarvis | |
| 3,631,555 | A | | 1/1972 | Hurst et al. | |
| 4,185,824 | A | | 1/1980 | Natwick | |
| 4,215,867 | A | | 8/1980 | Natwick | |
| 4,420,038 | A | * | 12/1983 | Okouchi et al. | 165/95 |
| 4,467,488 | A | | 8/1984 | Creek | |
| 4,556,102 | A | * | 12/1985 | Bochinski et al. | 165/95 |
| 4,974,277 | A | | 12/1990 | Casella | |
| 5,107,820 | A | | 4/1992 | Salansky | |
| 5,139,576 | A | * | 8/1992 | Davis | 134/8 |
| 5,396,876 | A | | 3/1995 | Liscio et al. | |
| 5,482,111 | A | * | 1/1996 | Bizard | 165/95 |
| 5,515,734 | A | | 5/1996 | Malminen | |
| 5,555,585 | A | | 9/1996 | Fowler | |
| 6,013,306 | A | * | 1/2000 | Sowden | 427/2.14 |

FOREIGN PATENT DOCUMENTS

| | | | |
|---|---|---|---|
| JP | 58-78098 | * | 5/1983 |
| JP | 59-200199 | * | 11/1984 |
| JP | 59-215599 | * | 12/1984 |
| JP | 62-87799 | * | 4/1987 |
| JP | 62-134498 | * | 6/1987 |
| JP | 1-244292 | * | 9/1989 |

* cited by examiner

*Primary Examiner* — Randall Chin
(74) *Attorney, Agent, or Firm* — Norman E. Lehrer

(57) ABSTRACT

An exiting cleaning projectile verification system for a tube cleaning system includes a tube cleaning system having a control system for controlling the cleaning system, a projectile launcher, a projectile, a tube, and a containment system, the cleaning projectile being launched through the tube and cleaning the interior of the tube, the projectile exiting the tube and entering the containment system and a sensor that detects the projectile exiting the tube. The sensor is in communication with the containment system. The sensor may include an electric eye that detects the presence of the projectile entering the containment system. The sensor may also include a feedback line connected to the control system that automatically shuts off the control system when a problem is detected. The sensor may also emit an audible signal. One or more counters count the number of projectiles launched and the number entering the containment system. A difference in the count is an indication of a problem.

6 Claims, 1 Drawing Sheet

10
12
13
14
16
18
20
22
24
26
28
30
32
34
36
38
40
42
2

CLEANING PROJECTILE VERIFICATION SYSTEM

CROSS-REFERENCE TO RELATED APPLICATIONS

This application is a Continuation-In-Part of U.S. patent application Ser. No. 11/265,356 filed Nov. 2, 2005 now abandoned which is hereby incorporated by reference.

BACKGROUND OF THE INVENTION

The present invention is directed toward a verification system for use with the projectile cleaning of a tube or pipe and more particularly, toward a verification system that indicates whether a cleaning projectile has exited the tube, pipe or hose that is being cleaned by the projectile.

Dirt and debris often accumulates in tubes, hoses and pipes used commercially and as well as by individuals. Some examples where tubes and pipes are used is in heat exchangers and condensers, steam boilers, oil, gas, and chemical processing, earthmoving equipment, and gun barrels. Traditional cleaning methods used to clean such structures often involve dismantling the system's components and using chemical cleaning substances that may be harmful to the user.

The cleaning solution may be placed on a swab of absorbent material and forced or drawn through the tube or pipe with an elongated rod or the like. While such cleaning systems may be useful when the tubes or pipes are relatively short, they are of little value when the tubes or pipes are long. In processing systems, for example, tubes may be hundreds of feet long and/or may pass between various rooms or floors of a building.

It is also known in the art to clean the interior of tubes or pipes by forcing foam-like projectiles through the tube utilizing compressed air as the propellant. Such systems normally utilize a pneumatic gun or launcher to propel the projectile through the entire length of tube. As the foam projectile is forced through the interior of the tube, it scrapes and cleans the inside walls thereof. See, for example U.S. Pat. Nos. 3,631,555 and 4,467,488. Other launchers and projectiles for use with such cleaning systems are shown, for example, in U.S. Pat. Nos. 1,547,440; 1,806,270; 4,974,277 and 5,555,585. As is common with such prior art cleaning systems, the projectile are forced through the entire length of tube or pipe and, after cleaning the interior thereof, exits the distal end of the tube or pipe. The distal end of the tube is frequently inserted into a large drum which is used to collect the dirty, spent projectiles.

Because the distal end of the tube being cleaned is located within a drum, it is sometimes impossible to determine whether the spent projectile actually exits the tube and enters the drum. This becomes a particularly difficult problem when the collection drum is located in a different room or is otherwise not visible to the person doing the cleaning. As a result provisions must be made to manually inspect or otherwise test every tube after it has been cleaned to ensure that the projectile did not remain in the tube. Obviously, allowing a projectile to remain in a tube would interfere with the proper operation of the processing equipment or other apparatus with which the tube is used.

Therefore, a need exists for a system that provides an accurate indication as to whether or not a cleaning projectile has properly passed entirely through a hose, tube or pipe being cleaned. Such a system could allow for an automated cleaning system for tubes, hoses or pipes.

SUMMARY OF THE INVENTION

The present invention is designed to overcome the deficiencies of the prior art discussed above. It is an object of the present invention to provide a simple and efficient cleaning system for tubes, hoses or pipes.

It is another object of the present invention to provide a verification system that provides an indication that a cleaning projectile has passed through and exited a hose, pipe or tube being cleaned.

In accordance with the illustrative embodiments demonstrating features and advantages of the present invention, there is provided an exiting cleaning projectile verification system for a tube cleaning system where a tube is being cleaned by a projectile comprising a tube cleaning system that includes a control system for controlling the cleaning system, a projectile launcher, a projectile, a tube, and a containment system, the cleaning projectile being launched through the tube and cleaning the interior of the tube, the projectile exiting the tube and entering the containment system and means for sensing the projectile exiting the tube, the sensing means being in communication with the containment system. The sensing means includes an electric light that detects the presents of the projectile entering the containment system. The sensing means also includes means for automatically shutting off the control system when the projectile exits the tube or when a problem is detected such as the fact that the projectile has not exited within a preset time period. The sensing means may also emit an audio signal when the projectile exits the tube or indicate a problem. One or more counters count the number of projectiles launched and the number entering the containment system. A difference in the count is an indication of a problem.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figures 1, 2:
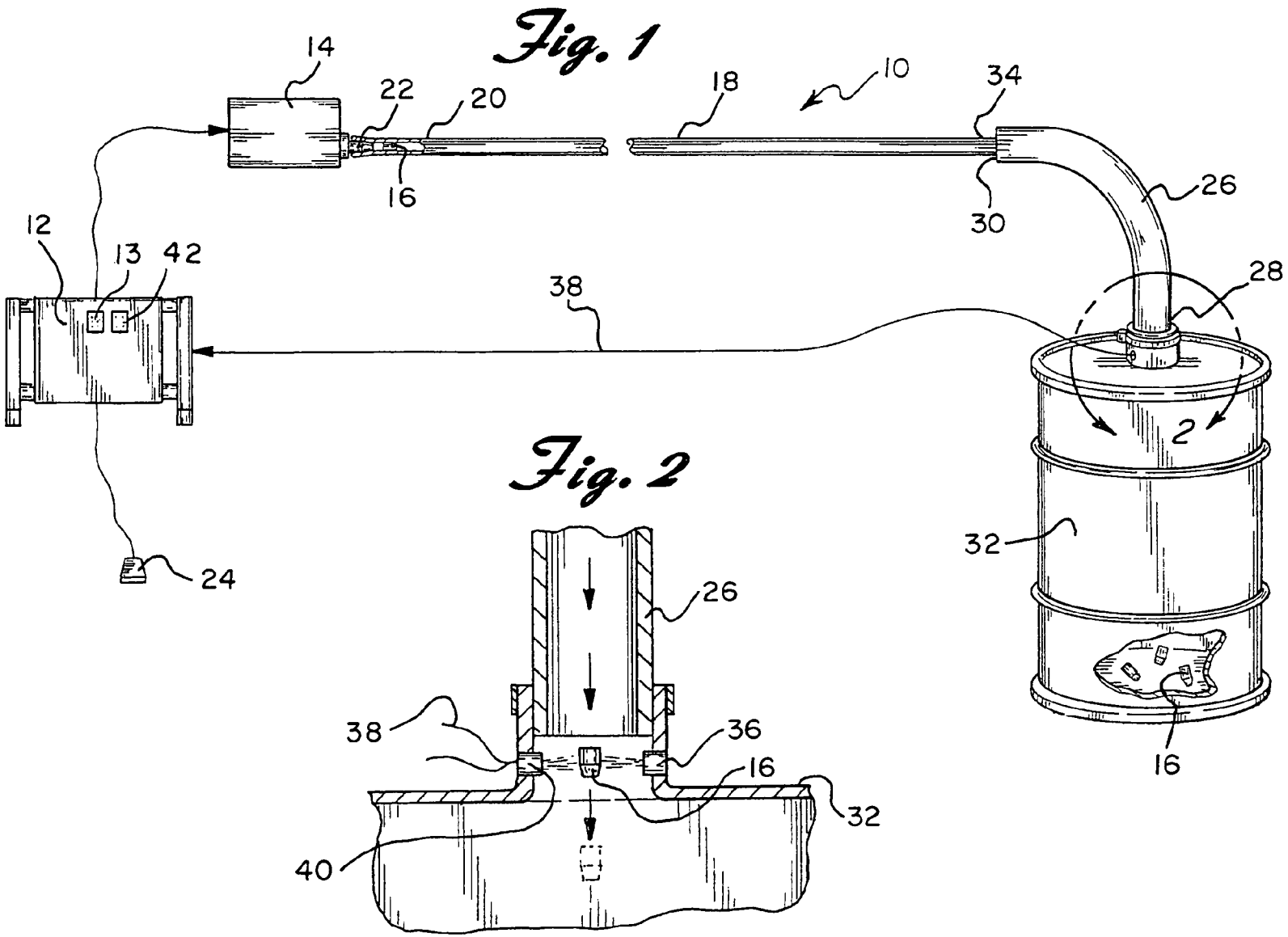
FIG. 1 is a flow diagram illustrating the projectile verification system of the present invention and FIG. 2 is a partial cross-sectional view of the area in the vicinity of the arrow 2 in FIG. 1.

Referring now to the drawings in detail wherein like reference numerals have been used in figures to designate like elements, there is shown in FIG. 1 a projectile verification system constructed in accordance with the principles of the present invention and designated generally as 10.

The exiting cleaning projectile verification system of the present invention essentially includes a tube cleaning system with a sensor that indicates whether the cleaning system is functioning properly.

The tube cleaning system includes a control system 12 for controlling the cleaning system, a projectile launcher 14, a projectile 16, a tube 18 to be cleaned, and a containment system for spent or used projectiles. (See FIG. 1.) The launcher 14 is attached to a first end 20 of the tube 18 to be cleaned via a nozzle 22. The control system activates the launcher 14 so that the projectile 16 contained within the launcher 14 is propelled through the tube 18. The projectile 16 may be made from a foam material or the like and may have an abrasive surface or may carry a cleaning solution.

The control system 12 may be controlled by a switch which may be in the form of a foot pedal 24. The control system 12 also includes a counter 13 so that as each projectile is launched, it will be counted and the number displayed. As the projectile 16 passes through the tube 18, it cleans the interior of the tube. The containment system includes a hose connection 26 having a first end 28 and second end 30 and a barrel or drum 32 for collecting spent projectiles attached to the first end 28 the hose 26. The second end 34 of the tube 18 fits loosely into the second end 30 of the hose 26. The projectile 16, after cleaning the tube 18 is intended to exit the tube 18 and enter the drum 32 through the hose 26.

When using a cleaning system as just described, it is not always possible to determine whether the projectile 16 has exited the tube 18 being cleaned. This problem is exasperated if the drum 32 is located at a position that is remote from the location of the person operating the control system 12.

Accordingly, in the present invention, means are provided for sensing the projectile exiting the tube 18 and entering the containment system. The sensing means includes an electric eye comprised of a light emitter 36 and a light sensor 40. Normally, light from the emitter 36 impinges on and is sensed by the sensor 40. However, when a projectile passes between the emitter 36 and the sensor 40, the light is interrupted momentarily and this is sensed by the sensor 40. (See FIG. 2.) The sensing means may also include means for automatically shutting off the control system when a problem is detected such as too much time passing between the launching of a projectile and the sensing of the same by the sensing means. The shut off means may include a feedback line 38 that is connected to the control system 12. (See FIG. 2.) The sensing means may also emit an audio signal to indicate a problem.

In order to use the system of the present invention, the launcher 14 is activated by depressing the foot pedal 24 so that a cleaning projectile 16 is forced by air through the tube 18. The projectile 16 exits the tube 18 and enters the containment system. The sensor 40 senses when a projectile 16 has entered the drum 32 and sends an interrupt signal back through line 38 to the control system 12. Upon receipt of an OK signal, the control system will reset to allow another projectile to be launched. At the same time, an audible or visual alarm may be activated to indicate to the operator that a projectile has properly passed through the tube. As a further check, another counter 42 may be included in the control system 12 that is in communication with line 38 so that each projectile is counted and the number displayed as the spent projectile enters the drum 32. The numbers displayed on the counters 13 and 42 can be compared and will serve as an accounting system so that all of the projectiles entering and exiting the tube being cleaned are accounted for. Any discrepancy in the comparison is an indication of a problem such as a projectile remaining in the tubing being cleaned.

If a projectile 16 does not enter the drum 32 of the containment system within a predetermined period of time, the sensor 40 will not send an interrupt signal back to the control system 12. This is an indication that something has gone wrong and the control system 12 can be programmed to emit an error alarm which may also be audible or visual. Obviously, the error signal should be different from the OK signal mentioned above. Upon receipt of an error signal, the control system 12 may also be programmed to automatically shut off the cleaning system 10. The cleaning system may then be investigated to determine what or where the problem lies. Once the non-exiting projectile has been removed and the malfunction corrected, the system may be reset and activated again.

It should be realized that while the cleaning system has been described with only one projectile being used, any number of projectiles may be stored within the launcher to be released at predetermined intervals and rates.

The present invention may be embodied in other specific forms without departing from the spirit or essential attributes thereof and accordingly, reference should be made to the appended claims rather than to the foregoing specification as indicating the scope of the invention.

I claim:

1. A cleaning projectile verification system for a tube cleaning system that includes a tube being cleaned by projectiles comprising:

a tube cleaning system that includes a control system for controlling said cleaning system, a projectile launcher, a plurality of projectiles, a tube, and a containment system for containing spent projectiles, said cleaning projectiles being launched through said tube and cleaning the interior of said tube, said projectiles exiting said tube and entering said containment system;

first sensing means for sensing when a projectile is launched by said launcher;

second sensing means for sensing each spent projectile exiting said tube and entering said containment system, said second sensing means being located within said containment system;

means for indicating that a spent projectile has entered said containment system, said indicating means including a counter for counting the number of spent projectiles entering said containment system;

timing means initiated each time a projectile is launched by said launcher, and said timing means emitting an error signal if more than a predetermined amount of time passes between the time that said timing means is initiated and said second sensing means senses that a spent projectile has exited said tube.

2. The cleaning projectile verification system of claim 1 wherein said second sensing means includes an electric eye that detects the presence of a spent projectile entering said containment system.

3. The cleaning projectile verification system of claim 1 further including means for counting each projectile as it is launched.

4. The cleaning projectile verification system of claim 1 wherein said timing means includes means for automatically shutting off said control system.

5. The cleaning projectile verification system of claim 1 wherein said indicating means emits an audible signal.

6. The cleaning projectile verification system of claim 1 wherein said error signal is audible.

* * * * *